United States Patent [19]

Boden

[11] Patent Number: 4,458,898

[45] Date of Patent: Jul. 10, 1984

[54] RACQUET WITH STRING POSITIONING ELEMENTS

[76] Inventor: Robert O. Boden, 1580 Gaywood Dr., Altadena, Calif. 91001

[21] Appl. No.: 369,491

[22] Filed: Apr. 19, 1982

[51] Int. Cl.[3] ..... A63B 51/00

[52] U.S. Cl. ..... 273/73 D

[58] Field of Search ..... 273/73 R, 73 C, 73 D, 273/73 E

[56] References Cited

U.S. PATENT DOCUMENTS

| | | | |
|---|---|---|---|
| 455,632 | 7/1891 | Malings | 273/73 D |
| 1,132,214 | 3/1915 | Ries et al. | 273/73 D |
| 3,834,699 | 9/1974 | Pass | 273/73 D |
| 3,921,979 | 11/1975 | Dischinger | 273/73 R |
| 3,999,756 | 12/1976 | Head | 273/73 C |
| 4,013,289 | 3/1977 | Kaminstein | 273/73 D |
| 4,033,582 | 7/1977 | Linden | 273/73 D |
| 4,172,596 | 10/1979 | Linden | 273/73 D |
| 4,190,249 | 2/1980 | Fischer | 273/73 D |
| 4,231,575 | 11/1980 | Kutt et al. | 273/73 D |
| 4,249,731 | 2/1981 | Amster | 273/73 D |
| 4,273,331 | 6/1981 | Fischer | 273/73 D |
| 4,299,385 | 11/1981 | Boden | 273/73 D |

FOREIGN PATENT DOCUMENTS

| | | | |
|---|---|---|---|
| 2634599 | 2/1978 | Fed. Rep. of Germany | 273/73 D |
| 2656082 | 6/1978 | Fed. Rep. of Germany | 273/73 D |
| 2730739 | 1/1979 | Fed. Rep. of Germany | 273/73 D |
| 855902 | 2/1940 | France | 273/73 D |
| 901279 | 10/1944 | France | 273/73 D |
| 5248 | of 1880 | United Kingdom | 273/73 D |
| 143481 | 5/1920 | United Kingdom | 273/73 D |
| 300700 | 11/1928 | United Kingdom | 273/73 D |

*Primary Examiner*—Richard C. Pinkham
*Assistant Examiner*—Matthew L. Schneider
*Attorney, Agent, or Firm*—William P. Green

[57] ABSTRACT

A racquet having two sets of strings crossing one another and preferably interwoven, and having at least one string positioning element engaging and extending along a string of one of the sets and contacting a plurality of strings of the second set in a relation preventing lateral deflection thereof at the points at which the strings cross one another, while permitting deflection of the strings of the second set at locations between those cross points. This enables the application of spin forces to a ball by such deflection while at the same time minimizing wear by virtue of retention of the strings against relative motion at the crossing points. The positioning elements are preferably tubular and desirably disposed about the transverse strings of a racquet, and may contain notches for receiving successive longitudinal strings in locating relation.

15 Claims, 8 Drawing Figures

RACQUET WITH STRING POSITIONING ELEMENTS

BACKGROUND OF THE INVENTION

This invention relates to improved racquets for use in tennis or other similar games.

In my U.S. Pat. No. 4,299,385 issued Nov. 10, 1981 on "Racquet", I have disclosed certain racquet stringing arrangements designed to increase the spin forces which can be applied to a ball, and otherwise improve the control of the ball, while preventing excessive wear of the strings at the points at which the longitudinal strings of the racquet cross the transverse strings. Those racquets include connector or positioning elements interconnecting different longitudinal strings at locations between two spaced transverse strings, with some of the transverse strings being spaced relatively far apart to provide regions within which the longitudinal strings are free for greater lateral deflection than in conventional racquets when contacted by a ball and as a result of such lateral deflection can exert rebounding forces against the ball in a manner imparting spin thereto.

SUMMARY OF THE INVENTION

The present invention provides a racquet structure which further reduces the amount of string wear occurring at the locations at which the two sets of strings of a racquet cross one another, without adversely affecting the amount that the strings may be deflected between the crossing points. It is preferred that the spacing between successive transverse strings be greater than in a conventional racquet, in order to allow increased lateral deflection or bowing of the strings at that location when the strings are impacted by a ball. However, the invention can be applied to a more conventional stringing pattern in which the spacing between successive strings is essentially the same as in the usual type of racquet. In either arrangement, the above discussed advantage of minimizing wear at the crossing points of the strings is attained.

To accomplish this purpose, a racket embodying the invention includes at least one and preferably several positioning elements which are so located and constructed as to effectively retain the strings against relative motion at the points at which they cross one another, to thus prevent the wear which normally occurs as a result of such relative motion. Each such positioning element engages and extends along one string, preferably a transverse string, and has portions adapted to contact a plurality of crossing strings at spaced locations in a manner retaining those crossing strings against lateral deflection. To prevent such relative displacement of the crossing strings (preferably the longitudinal strings), the positioning element has shoulder surfaces or positioning surfaces which are disposed across the path of deflecting movement of the crossing strings, to block such deflection. These positioning shoulders or surfaces may be provided by forming in the positioning element a plurality of spaced notches into which the crossing strings are received in confined and locating relation. For best results, the positioning element is essentially tubular, with one of the transverse strings extending therethrough, and with notches being formed as discussed in opposite sides of the tube. In order to enable easy injection molding of such a positioning element, elongated slots may be formed in the side wall of the tube at locations opposite the notches.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
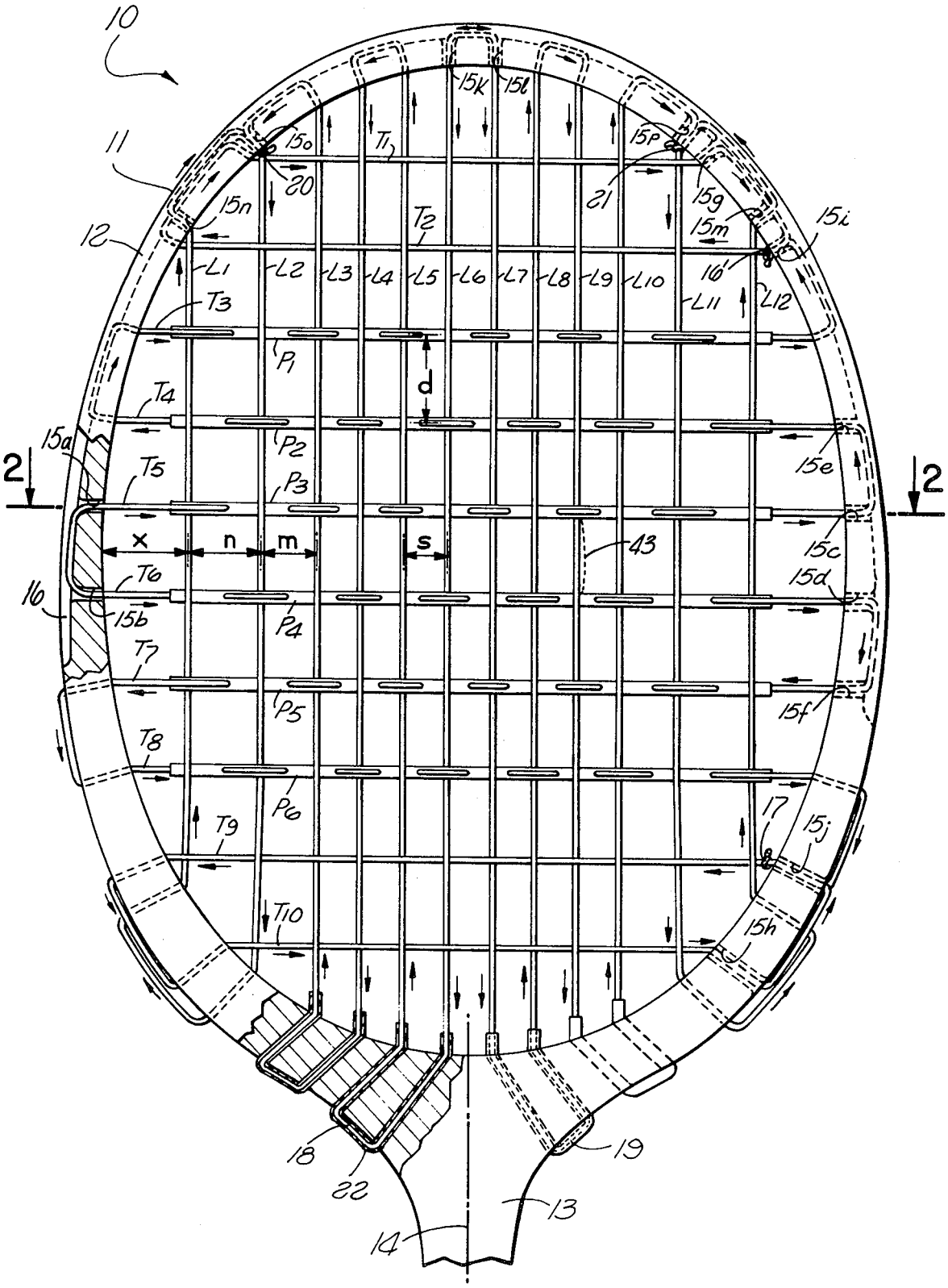
FIG. 1 is a front elevational view of a tennis racquet constructed in accordance with the invention, with the handle shown only fragmentarily.

The tennis racquet 10 illustrated in FIGS. 1 through 6 includes a racquet body 11 having a loop portion 12 and a handle portion 13 projecting therefrom along the longitudinal axis 14 of the racquet. The strings of the racquet include a set of longitudinal strings, preferably twelve in number, identified in FIG. 1 as L1, L2, L3, etc., and a series of transverse strings extending perpendicular to the longitudinal strings and to axis 14, preferably ten in number, and identified in FIG. 1 as strings T1, T2, T3, T4, T5, etc. The loop portion 12 of the racquet body contains openings 15 through which the strings extend, and may be of essentially conventional construction except that fewer stringing openings 15 are required than in a conventional racquet. It should be noted, however, that the particular stringing arrangement illustrated in FIGS. 1 to 6 may be employed in a racquet body having exactly the same distribution of stringing openings in the loop portion of the body as in a conventional racquet, but with some of those openings being unused in the FIGS. 1 to 6 pattern.

As seen best in FIG. 1, a number of transverse strings carry positioning elements, preferably six in number, identified as elements P1, P2, P3, etc., for retaining the longitudinal strings against lateral displacement at the locations at which they cross the transverse strings.

The transverse strings may all be formed of a single length of stringing material, typically nylon or gut, wound back and forth horizontally or transversely in the pattern illustrated in FIG. 1. Approximately the upper half of the loop portion 12 of racquet body 11 may contain an external groove 16 within which the strings are doubled back between openings in protected fashion. The stringing material which forms the transverse strings may first have its opposite ends inserted inwardly (rightwardly) through the openings 15*a* and 15*b* of FIG. 1, then be threaded through the two central positioning elements P3 and P4 respectively, after which the two halves of the string may be passed rightwardly through the openings 15*c* and 15*d*, and then inserted leftwardly through the adjacent openings 15*e* and 15*f* to form the next adjacent transverse strings T4 and T7. This portion of the stringing material is threaded through positioning elements P2 and P5 and then doubled back at the left side of the racquet to form the next successive transverse strings T3 and T8. This process is continued until all of the transverse strings have been formed, with the extremities of the stringing material finally extending out through openings 15*g* and 15*h* and back in through openings 15*i* and 15*j* to be tied off at 16' and 17 about the transverse strings T2 and T9. During the threading of the transverse strings leftwardly and rightwardly in the racquet body, the stringing material is of course threaded through the various positioning elements P1, P2, P3, etc. as illustrated.

The longitudinal strings L1, L2, L3, etc. may also be similarly formed of a single length of stringing material, which is first passed downwardly through the openings designated 15*k* and 15*l* in FIG. 1, then being doubled back at 18 and 19 to form the next adjacent longitudinal strings L5 and L8, with this process continuing upwardly and downwardly until all of the longitudinal strings have been formed, and the extremities of this stringing material are passed outwardly through openings 15*m* and 15*n*, and then inwardly through openings 15*o* and 15*p* to be tied off to the longitudinal stringing material at 20 and 21. String protecting tubing may be utilized about the throat portions of the longitudinal strings as represented at 22.

As the longitudinal strings are applied to the racquet body, they are interwoven with the transverse strings in conventional manner so that each of the longitudinal strings in extending downwardly is received at the front side of one transverse string, behind the next transverse string, in front of the next transverse string, etc., and similarly each transverse string is received in front of a first longitudinal string, behind the next longitudinal string, in front of the next longitudinal string, etc. More particularly, referring to the longitudinal string which is identified as L6 in FIG. 1, that string is received in front of transverse string T1, behind transverse string T2, in front of string T3, behind string T4, in front of string T5, behind string T6, in front of string T7, behind string T8, in front of string T9, and behind string T10. The adjacent strings L5 and L7 are interwoven with the transverse strings in exactly the opposite manner. More particularly, strings L5 and L7 are received behind string T1, in front of string T2, behind string T3, in front of string T4, behind string T5, in front of string T6, behind string T7, in front of string T8, behind string T9, and in front of string T10. This alternate interweaving arrangement is continued across the entire face of the racquet with strings L2, L4, L8, L10 and L12 being interwoven with the transverse strings in the same way as L6, and with strings L1, L3, L9, and L11 being interwoven with the transverse strings in the same way as strings L5 and L7.

In the arrangement illustrated in FIG. 1, the transverse strings, T1, T2, etc. are spaced apart a distance d which is preferably greater than the spacing between successive transverse strings in most conventional racquets, with the distance d optimally being about one inch and essentially the same spacing between each pair of successive transverse strings. At and near the center of the racquet, the longitudinal strings are spaced apart a distance s which is desirably less than the distance d between successive transverse strings. In the illustrated arrangement, strings L3 and L4 are spaced apart this distance s, as are strings L4 and L5, L5 and L6, L6 and L7, L7 and L8, L8 and L9, and L9 and L10. Laterally beyond this central group of longitudinal strings L3 through L10, the longitudinal strings are spaced apart progressively greater distances. For example, strings L2 and L3 and strings L10 and L11 are spaced apart a distance m which is greater than the distance s and may be just slightly smaller than the distance d. Strings L1 and L2 and strings L11 and L12 may be spaced apart a still greater distance n, still typically slightly less than the distance d, and the maximum spacing x between each of the strings L1 and L12 and the loop portion 12 of the racquet body may be still greater than the distance n.

The positioning elements P1, P2, P3, etc. may all be identical, and each may be considered as forming in essence a tube having an internal diameter slightly larger than the external diameter of the stringing material, to be received and carried thereabout. The positioning elements are formed of a tough wear resistant material, preferably an appropriate essentially stiff resinous plastic material such as nylon. Each positioning element has an outer cylindrical surface 23 concentric about the longitudinal axis 24 of the positioning element with the internal cylindrical passage 25 through which the associated transverse string extends. External surface 23 may be considered as continuously cylindrical except as interrupted by certain notches and elongated slots formed in the side wall of the positioning element.

Figure 2:
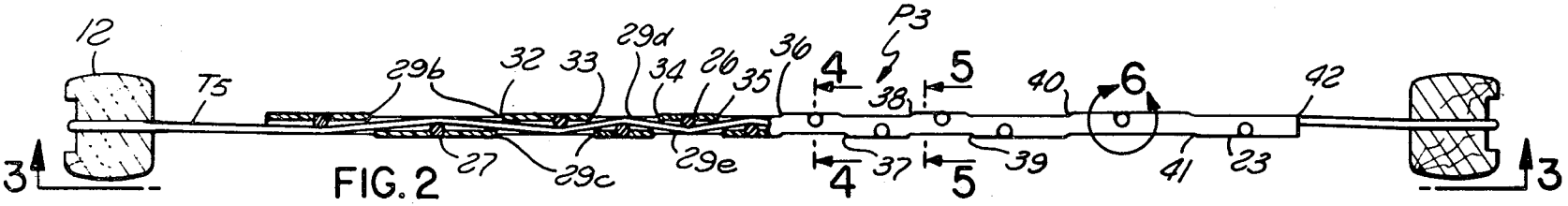
FIG. 2 is an enlarged horizontal sectional view taken on line 2—2 of FIG. 1.
Figure 3:
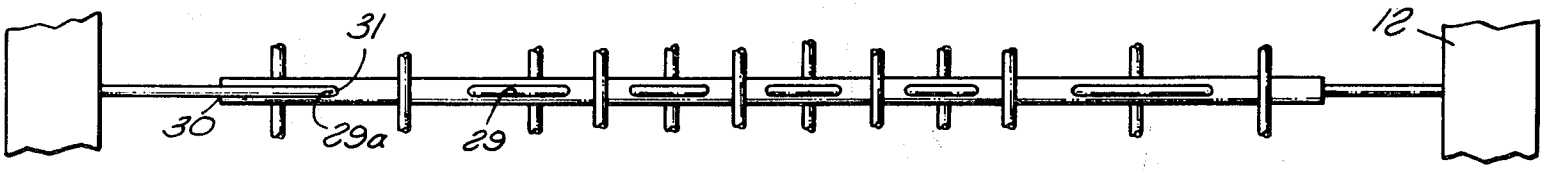
FIG. 3 is a front elevational view of one of the connector elements and the contacted portions of the strings taken on line 3—3 of FIG. 2.

As seen in FIG. 2, the side wall of each of the tubular positioning elements contains at its rear side a series of notches 26 at the locations of the different longitudinal strings which pass behind that particular positioning element and the contained transverse string. A similar series of forwardly facing notches 27 are formed in the front of the positioning element at the locations of each of the longitudinal strings which are received in front of the positioning element. Each of the notches is shaped to be defined by two oppositely facing surfaces 28 (FIG. 6) disposed directly transversely of axis 24 and functioning as shoulders engageable with opposite sides of a corresponding one of the longitudinal strings L1, L2, L3, etc. in a relation blocking deflection of that string longitudinally of the positioning element (along axis 24). These shoulder surfaces 28 are thus positioned directly in the path of such deflection of the engaged longitudinal strings, to effectively retain the longitudinal strings against movement parallel to axes 24 at the locations at which the longitudinal strings cross the transverse strings. Notches 26 may extend entirely through the radial thickness of the side wall of tubular positoning element 23, enabling the longitudinal strings to actually touch the transverse strings while being confined against lateral deflection, or alternatively, the notches may if desired extend only partially through the thickness of the side wall of the positioning element.

In order to facilitate formation of the positioning elements by an injection molding process, elongated slots 29 may be formed in the side wall of each of the positioning elements at locations opposite the various notches 26 and 27. For example, referring to FIGS. 2 and 3, a first slot 29*a* may be formed in the front side of positioning element P3 opposite a first of the rear notches 26, with the slot 29*a* extending from the left end 30 of the positioning element to a location 31. Continuing rightwardly beyond that point, a slot 29*b* may be formed in the back of the positioning element from essentially the location 31 to a location 32, beyond which another front slot 29*c* may be formed from the location 32 to the location 33, with a rear slot 29*d* then being formed between the locations 33 and 34, a front slot 29*e* extending between the locations 34 and 35, a rear slot extending between the locations 35 and 36, a front slot between the locations 36 and 37, a rear slot between the locations 37 and 38, a front slot between the locations 38 and 39, a rear slot between the locations 39 and 40, a front slot between the locations 40 and 41, and a rear slot between the location 41 and the right extremity 42 of the tubular part. The slots 29*a*, 29*b*, etc. all may have a vertical extent corresponding to the diameter of the passage 25 through the interior of part P3, so that if two mold halves are separated along axis 24 they may have projections or pin portions extending through the elongated slots 29 into the interior of the positioning element to form the central passage through the part during injection molding.

Figure 2A:
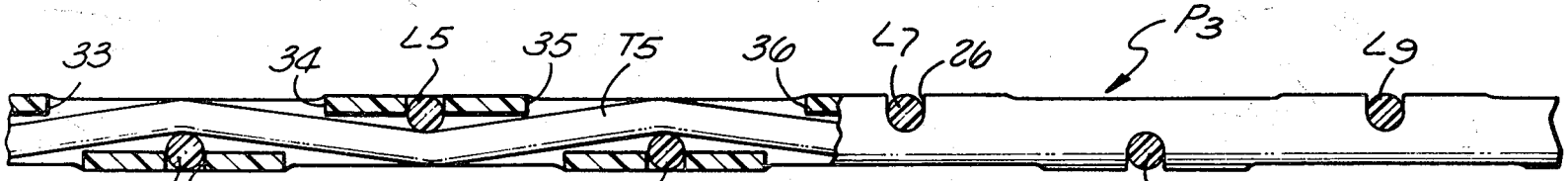
FIG. 2A is an enlargement of a portion of FIG. 2.
Figure 6:
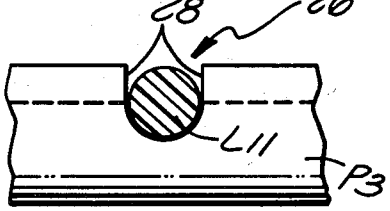
FIG. 6 is an enlarged detail view taken at the location of the circle identified by the number 6 in FIG. 2.
Figure 5:
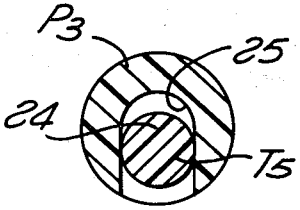
FIGS. 4 and 5 are further enlarged transverse sections taken on lines 4—4 and 5—5 respectively of FIG. 2.
Figure 4:
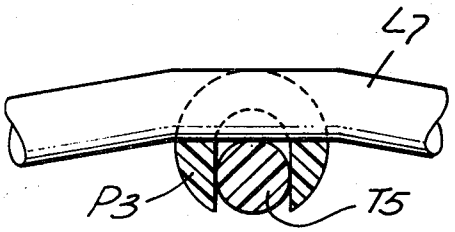
Figure 2:
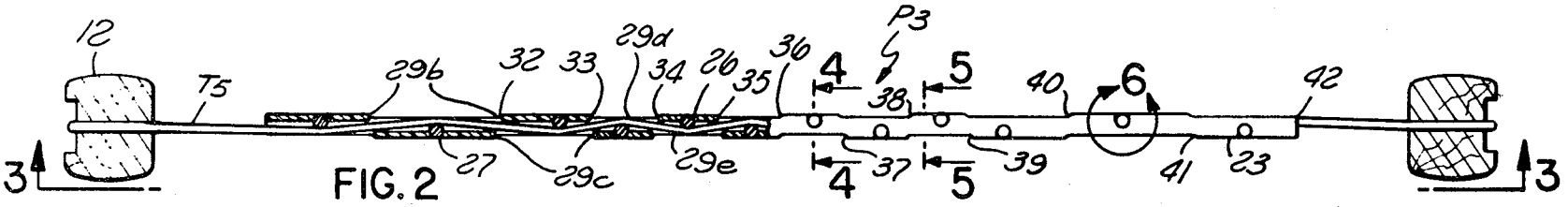
Figure 3:
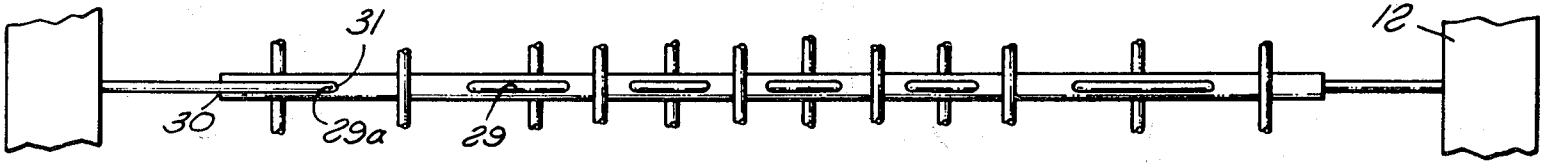
Figure 2A:
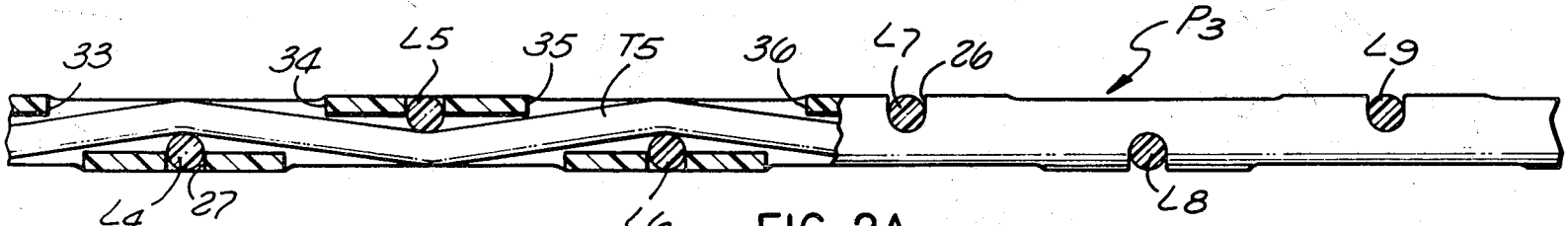
Figure 6:
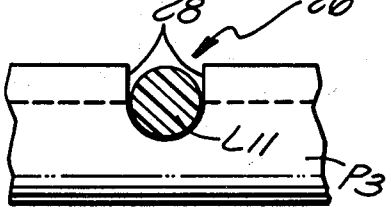
Figure 5:
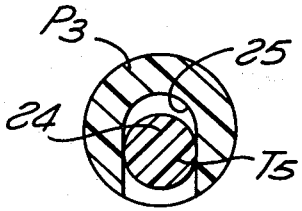
Figure 4:
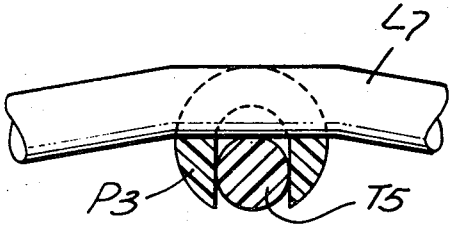

Furthermore, as seen in the FIG. 2A embodiment, the portion of transverse string T5 which is illustrated directly beneath longitudinal string L5 is deflected downwardly by the tension of string L5 into one of the slots 29 therebeneath. Similarly, the portion of string T5 which is illustrated directly above string L6 in FIG. 2A is deflected upwardly into a second of the slots in element P3. The same condition exists at each of the other slots.

During assembly of the parts, the positioning ments are so located that the various notches formed in their front and rear sides properly receive the different longitudinal strings. Since each of the longitudinal strings is received behind some of the transverse strings and in front of others, the notches on each of the positioning elements must be turned to receive longitudinal strings at the proper locations. For this purpose, positioning elements P1 and P5 are both turned about their corresponding transverse strings to conditions corresponding to element P3 illustrated in FIGS. 2 and 3 and discussed in detail above. The positioning elements P2, P4 and P6 are all turned about their respective transverse strings and axes through one-hundred and eighty degrees from the position of element P3 of FIGS. 2 and 3, so that the notches 26 of FIG. 2 are received at the front of positioning elements P2, P4, and P6, while the notches 27 are at the rear sides of those positioning elements. As will be further apparent from the drawings and description, the spacing of the notches corresponds to the previously discussed spacing pattern of the longitudinal strings, that is, with the notches being relatively close together near the center of the racquet and progressively farther apart toward its opposite sides.

When the racquet of FIGS. 1 through 6 is in use, the portions of the longitudinal strings between successive transverse strings are able to flex substantially in a lateral direction (parallel to axes 24 of the positioning elements P1, P2, etc.) and that lateral deflection of the longitudinal strings between successive transverse strings (as represented diagrammatically at 43 in FIG. 1) enables greater spin to be imparted to the ball than in a conventional racquet. In spite of this freedom for increased lateral deflection of the longitudinal strings, however, those strings are effectively locally retained against lateral deflection at the locations at which they cross the transverse strings by reason of reception of the longitudinal strings at those locations in grooves or notches 26 and 27 of the positioning elements. This retention of the longitudinal strings against movement relative to the transverse strings at the locations at which the strings cross one another prevents the strings from rubbing together and producing wear as a result of such a rubbing action. Further, the increased spacing between successive longitudinal strings near opposite sides of the racquet allows greater lateral deflection of the longitudinal strings at those locations than in a conventional racquet, to thereby increase the time that a ball is in contact with the strings near the side of the racquet and increase the effectiveness with which a ball can be struck at an off-center location, while at the same time maintaining the strings against relative rubbing movement at the crossing points even near the sides of the racquet.

Figure 7:
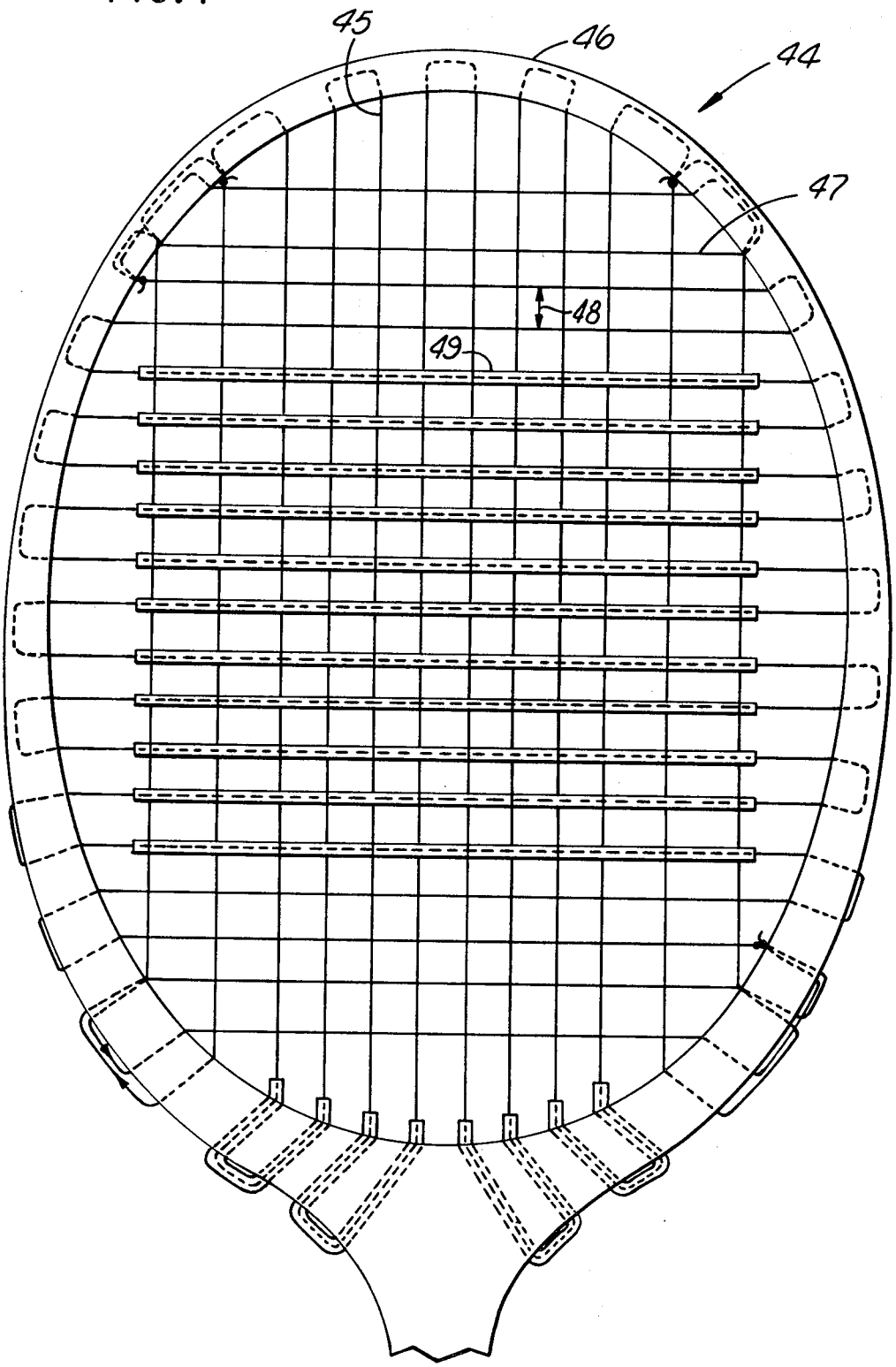
FIG. 7 is a view similar to FIG. 1, but showing a racquet with a variational string pattern.

FIG. 7 shows a variational form of racquet 44 which may be considered as identical with that of FIGS. 1 to 6 except with regard to the spacing between successive transverse strings. The longitudinal strings 45 of FIG. 7 may be mounted in the racquet body 46 in the same manner as in FIG. 1, but with the longitudinal strings being interwoven with an increased number of transverse strings 47 spaced apart a distance 48 which is slightly greater than the distance s of FIG. 1. This distance 48 may be the same as the spacing of transverse strings in a conventional racquet, typically about one-half inch. The positioning elements 49 of FIG. 7 may be constructed the same as the positioning elements P1, P2, etc. of FIGS. 1 to 6, to be received about the various transverse strings and engage the various longitudinal strings in locating relation within the notches 50. Each of the longitudinal strings of course extends in front of and behind alternate transverse strings, and each transverse string extends alternately in front of and behind successive longitudinal strings, to provide a fully interwoven pattern.

In using the racquet of FIG. 7, the strings are free to deflect between the points at which the longitudinal strings cross the transverse strings, but the longitudinal strings are restrained against lateral movement relative to the transverse strings at the crossing points, to prevent wear at those locations as in the first form of the invention. The progressive increase in spacing of the longitudinal strings toward opposite sides of the racquet has the same effect as in the first form in increasing the area over which a ball can be struck effectively by the racquet.

In both forms of my invention, most of the energy lost to the heat of friction caused by the strings rubbing against each other in a conventional racket is transferred to the ball in the form of additional rotational and/or translational energy as desired.

While certain specific embodiments of the present invention have been disclosed as typical, the invention is of course not limited to these particular forms, but rather is applicable broadly to all such variations as fall within the scope of the appended claims.

I claim:

1. A racquet comprising:

a racquet body having a loop portion and a handle portion projecting therefrom;

longitudinal strings carried by said loop portion of the body and extending longitudinally of the racquet body;

transverse strings carried by said loop portion of the body;

said longitudinal and transverse strings being interwoven so that individual longitudinal strings in passing a series of transverse strings are received alternately at front and rear sides thereof, and individual transverse strings in passing a series of longitudinal strings are received alternately at front and rear sides thereof; and a plurality of essentially tubular positioning elements disposed about a plurality of said transverse strings respectively and each extending along a corresponding one of said transverse strings past a series of said longitudinal strings;

each of said tubular positioning elements containing a series of spaced notches at each of two opposite sides of a corresponding one of said transverse strings receiving a series of said longitudinal strings at each of said sides in a relation retaining said longitudinal strings against deflection transversely of their length relative to said positioning element.

2. A racquet as recited in claim 1, in which said transverse strings are spaced farther apart than are at least some of said longitudinal strings.

3. A racquet as recited in claim 1, in which said longitudinal strings are relatively close together near the center of said racquet and are spaced progressively farther apart near opposite side edges of the racquet, said transverse strings being spaced farther apart than are the longitudinal strings near the center of the racquet.

4. A racquet as recited in claim 3, in which said tubular positioning elements contain axially elongated slots opposite said notches respectively and each at a side of the positioning element opposite that at which a corresponding one of the notches is located.

5. A racquet as recited in claim 4, in which said elongated slots at one side of a positioning element extend axially between the locations of the elongated slots at the opposite side of said positioning element.

6. A racquet as recited in claim 1, in which said tubular positioning elements contian axially elongated slots opposite said notches respectively and each at a side of the positioning element opposite that at which a corresponding one of the notches is located.

7. A racket comprising:

a racket body having a loop portion and a handle portion projecting therefrom;

a set of first strings carried by said loop portion of the body and extending in a first direction;

a set of second strings carried by said loop portion of the body and extending in a second direction and crossing said first strings; and at least one positioning element engaging one of said first strings and extending therealong between the locations of a plurality of said second strings and having locating surfaces which are engageable with said plurality of second strings and which are located in the path of and act to block displacement of said plurality of second strings relative to said positioning element and longitudinally of said one first string;

said second strings being interwoven with said first strings, with different ones of said second strings being received at two different sides of said one first string;

said positioning element having said locating surfaces at both of said sides of said one first string engageable with different second strings at both of said sides to prevent deflection thereof relative to the positioning element and longitudinally of said one first string.

8. A racquet as recited in claim 7, in which said positioning element is essentially tubular and disposed about said one first string.

9. A racquet as recited in claim 7, in which said positioning element is essentially tubular and disposed about said one first string and contains notches at spaced locations along one side of said one first string for receiving and locating a plurality of said second strings, said positioning element containing elongated slots at an opposite side of said one first string with each slot being opposite one of said notches and with portions of said one first string projecting into said slots.

10. A racket comprising:

a racket body having a loop portion and a handle portion projecting therefrom;

a set of first strings carried by said loop portion of the body and extending in a first direction;

a set of second strings carried by said loop portion of the body and extending in a second direction and crossing said first strings; and at least one positioning element engaging one of said first strings and extending therealong between the locations of a plurality of said second strings and having locating surfaces which are engageable with said plurality of second strings and which are located in the path of and act to block displacement of said plurality of second strings relative to said positioning element and longitudinally of said one first string;

said positioning element being essentially tubular and disposed about said one first string and containing a plurality of spaced notches at each of two opposite sides of the positioning element receiving a plurality of said second strings at each of said sides and preventing deflection thereof relative to the positioning element and longitudinally of said one first string.

11. A positioning element for use with a racquet having first strings extending in a first direction and second strings extending in a second direction and crossing said first strings; said positioning element comprising:

a body to be located in engagement with one of said first strings and to extend along said one first string between the locations of a plurality of crossing second strings;

said body having locating surfaces receivable in the path of and acting to block deflection of said plurality of second strings relative to said positioning element and longitudinally of said one first string;

said body being essentially tubular and disposed about said one first string, and containing a plurality of spaced notches at each of two opposite sides for receiving and locating a plurality of said second strings at each of said sides respectively in a relation preventing deflection thereof transversely of their length.

12. A positioning element as recited in claim 11, in which said body has elongated slots at both of said sides thereof and each of which is located opposite one of said notches.

13. A positioning element as recited in claim 12, in which said elongated slots at one of said sides of the body extend axially between the locations of said elongated slots at the other side of the positioning element.

14. A racquet comprising:

a racquet body having a loop portion and a handle portion projecting therefrom;

a set of first strings carried by said loop portion of the body and extending in a first direction;

a set of second strings carried by said loop portion of the body and extending in a second direction and crossing said first strings; and at least one positioning element engaging one of said first strings and extending therealong between the locations of a plurality of said second strings and having locating surfaces which are engageable with said plurality of second strings and which are located in the path of and act to block displacement of said plurality of second strings relative to said positioning element and longitudinally of said one first string;

said positioning element containing a plurality of notches spaced apart longitudinally of said positioning element and receiving different ones of said second strings and forming a pair of said locating surfaces at each notch engageable with opposite sides of one of said second strings to prevent lateral deflection thereof in either of two opposite directions.

15. A racquet comprising:

a racquet body having a loop portion and a handle portion projecting therefrom;

a set of first strings carried by said loop portion of the body and extending in a first direction;

a set of second strings carried by said loop portion of the body and extending in a second direction and crossing said first strings; and at least one positioning element engaging one of said first strings and extending therealong between the locations of a plurality of said second strings and having locating surfaces which are engageable with said plurality of second strings and are located in the path of and act to block displacement of said plurality of second strings relative to said positioning element and longitudinally of said one first string;

said positioning element being essentially tubular and disposed about said one first string and containing notches at spaced locations along one side of said one first string for receiving and locating a plurality of said second strings, said positioning element containing elongated slots at an opposite side of said one first string with each slot being opposite one of said notches and with portions of said one first string projecting into said slots.

* * * * *